US008961162B2

(12) United States Patent
Solty

(10) Patent No.: US 8,961,162 B2
(45) **Date of Patent: *Feb. 24, 2015**

(54) POWDER PRESS

(71) Applicant: SMS Meer GmbH, Moenchengladbach (DE)

(72) Inventor: Walter Solty, Hueckelhoven (DE)

(73) Assignee: SMS Meer GmbH, Moenchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,561

(22) Filed: Jul. 3, 2013

(65) Prior Publication Data

US 2014/0010905 A1 Jan. 9, 2014

(30) Foreign Application Priority Data

Jul. 4, 2012 (DE) ..... 10 2012 013 229

(51) Int. Cl.

| | |
|---|---|
| ***B30B 11/00*** | (2006.01) |
| ***B30B 7/00*** | (2006.01) |
| ***B30B 11/04*** | (2006.01) |
| ***B30B 15/04*** | (2006.01) |

(52) U.S. Cl.

CPC . *B30B 7/00* (2013.01); *B30B 11/04* (2013.01); *B30B 15/045* (2013.01)

USPC ..... 425/78; 425/385; 72/465

(58) Field of Classification Search

CPC ..... B22F 3/03; B30B 11/02; B30B 15/041; F15B 15/1471

USPC ..... 425/78, 385; 72/456

See application file for complete search history.

(56) References Cited

U.S. PATENT DOCUMENTS

| | | | |
|---|---|---|---|
| 4,260,346 | A | 4/1981 | Anderson, Jr. et al. |
| 5,218,901 | A | 6/1993 | Imanishi |
| 7,803,294 | B2 | 9/2010 | Pannewitz et al. |
| 2004/0208948 | A1 | 10/2004 | Lee |
| 2008/0145466 | A1 | 6/2008 | Beane |

FOREIGN PATENT DOCUMENTS

| | | | |
|---|---|---|---|
| DE | 2 224 592 | A1 | 12/1972 |
| DE | 119 745 | A1 | 5/1976 |
| DE | 30 36 533 | A1 | 4/1981 |
| DE | 41 28 895 | A1 | 3/1992 |
| DE | 43 07 107 | C1 | 9/1994 |
| DE | 44 25 565 | A1 | 2/1996 |
| DE | 10 2005 035 920 | A1 | 3/2006 |

(Continued)

OTHER PUBLICATIONS

German Office Action dated Mar. 8, 2013 in German Patent Application No. 10 2012 013 229.8 with English translation of the relevant parts.

(Continued)

*Primary Examiner* — Jacob Thomas Minskey
(74) *Attorney, Agent, or Firm* — Collard & Roe, P.C.

(57) ABSTRACT

A powder press in which seals of cylinder/piston units that can hydraulically activate or apply pressure to additional plates with reference to a die plate, the upper yoke and/or the lower yoke are kept free of powder to the greatest possible extent disposes a cylinder of a cylinder/piston unit facing away from a die plate and/or an additional plate, preferably below the additional plate.

9 Claims, 4 Drawing Sheets

(56) References Cited

FOREIGN PATENT DOCUMENTS

| | | | |
|---|---|---|---|
| DE | 10 2005 027 296 | B3 | 11/2006 |
| DE | 10 2005 052 158 | A1 | 5/2007 |
| EP | 0 053 187 | A1 | 6/1982 |
| EP | 0 224 096 | A2 | 6/1987 |
| EP | 1 952 975 | A1 | 8/2008 |
| EP | 2 095 933 | A2 | 9/2009 |
| GB | 1 398 611 | A | 6/1975 |
| JP | 2007-100131 | A | 4/2007 |
| JP | 2009-291799 | A | 12/2009 |
| KR | 10-2011-0127780 | A | 11/2011 |
| SU | 1 771 880 | A1 | 10/1992 |
| WO | WO 2012/089198 | A1 | 7/2012 |

OTHER PUBLICATIONS

German Office Action dated Mar. 7, 2013 in German Patent Application No. 10 2012 013 227.1 with English translation of the relevant parts.

International Search Report of PCT/DE2011/002187, mailed Jun. 1, 2012.

Austrian Search Report dated Jan. 21, 2014 in Austrian Application No. A 550/2013 with English translation of relevant parts.

Austrian Search Report dated Jan. 22, 2014 in Austrian Application No. A 551/2013 with English translation of relevant parts.

POWDER PRESS

CROSS REFERENCE TO RELATED APPLICATIONS

Applicant claims priority under 35 U.S.C. §119 of German Application No. 10 2012 013 229.8 filed Jul. 4, 2012, the disclosure of which is incorporated by reference.

BACKGROUND OF THE INVENTION

1. Field of the Invention

The invention relates to a powder press having an upper yoke, a lower yoke, and tension elements that are in effect between the upper yoke and the lower yoke, as well as having a die plate that is guided parallel to the tension elements, and having at least one additional plate, preferably configured as a lower plate, which is also guided parallel to the tension elements, which plate can be hydraulically activated, with reference to the die plate, the upper yoke and/or the lower yoke, or to which plate pressure can be applied, via a cylinder/piston unit.

2. Description of the Related Art

Powder presses of a different type are known, for example, from DE 10 2005 027 296 B3, whereby here, ultimately multiple die plates are guided parallel to one another and additional plates, particularly lower plates, are not disclosed. Arrangements of the same type are known, however, for example from the still unpublished document PCT/DE2011/002187, whereby there, the precise manner in which the additional plates are activated is not disclosed.

SUMMARY OF THE INVENTION

It is an object of the present invention to make available a powder press of the stated type, in which seals of piston/cylinder units, which can hydraulically activate or apply pressure to additional plates, with reference to the die plate, the upper yoke and/or the lower yoke, are kept free of powder to the greatest possible extent.

These and other objects are achieved by a powder press according to the invention.

In this connection, a powder press having an upper yoke, a lower yoke, and tension elements that are in effect between the upper yoke and the lower yoke, as well as having a die plate that is guided parallel to the tension elements, and having at least one additional plate, preferably configured as a lower plate, which is also guided parallel to the tension elements, which plate can be hydraulically activated, with reference to the die plate, the upper yoke and/or the lower yoke, or to which plate pressure can be applied, via a cylinder/piston unit, can be characterized in that the cylinder of the cylinder/piston unit is disposed facing away from the die plate and/or the additional plate, preferably below the additional plate.

If it is suitably configured, such a powder press can be guided with greater precision and can have a low construction height. In total, the powder press can then be configured in such a manner that simple assembly and the disassembly are possible.

The placement of the cylinders, facing away from the die plate and/or from the additional plate, is particularly suitable for powder presses having an adapter on which the die plate is provided, which plate is accommodated on a die accommodation plate that accommodates the adapter, and which in turn comprises a head plate that is in effect on the head side of the die plate, a foot plate that is in effect on the foot side of the die plate, and a guide for the die plate that is in effect between the head plate and the foot plate, whereby the piston/cylinder unit supports itself on the head plate, on the foot plate, or on a module rigidly connected with the head plate or foot plate. Therefore the adapter forms a unit that is structurally closed in itself and stable, which unit has not only the die plate but also the additional plate, in displaceable manner.

Preferably, the cylinder is disposed on the additional plate, so that—together with the characteristic that it is disposed to face away from the die plate or from the additional plate—any seals of the cylinder/piston unit also face away from the die plate, and therefore powder can be kept away from the seals, to the greatest possible extent, as a result of the design. In this way, in particular, a basic idea of the present invention can be implemented, according to which not the pistons but rather the cylinders of the cylinder/piston unit are to be moved. This arrangement ultimately also brings about more stable guidance, if the remainder of the powder press or the remainder of the adapter is suitably configured.

The powder press has a particularly compact construction if the die plate and the additional plate have a common guide. In this connection, the die plate can particularly guide the additional plate.

Likewise, the additional plate can guide a further additional plate, so that particularly stable guidance can be guaranteed by means of the guidance of the plates relative to one another.

The guidance can be further stabilized if the cylinder is part of the additional plate guide, which ultimately can lead to the result that the entire powder press has a significantly more compact construction. With this arrangement, it might be possible to do without additional guides or supplemental guide arms or other guide arrangements, which must reach particularly from guide rods disposed further outward radially to additional plates disposed radially far inward, or the number and massiveness of such guides can be minimized.

In order to keep the oil requirement to a minimum, the piston can be configured to run synchronously with a further piston, or can be switched differentially.

Also, the surface area ratio of two piston/cylinder units can be selected to be 1:1, in order to thereby simplify the regulation behavior. In this connection, it is understood that with regard to the surface area ratio, specific tolerances, which can amount to as much as 10%, can certainly be tolerated, because in this way, the regulation behavior continues to be improved as compared with the state of the art.

It is understood that the characteristics of the solutions described above or in the claims can also be combined, in order to be able to implement the advantages cumulatively, accordingly.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
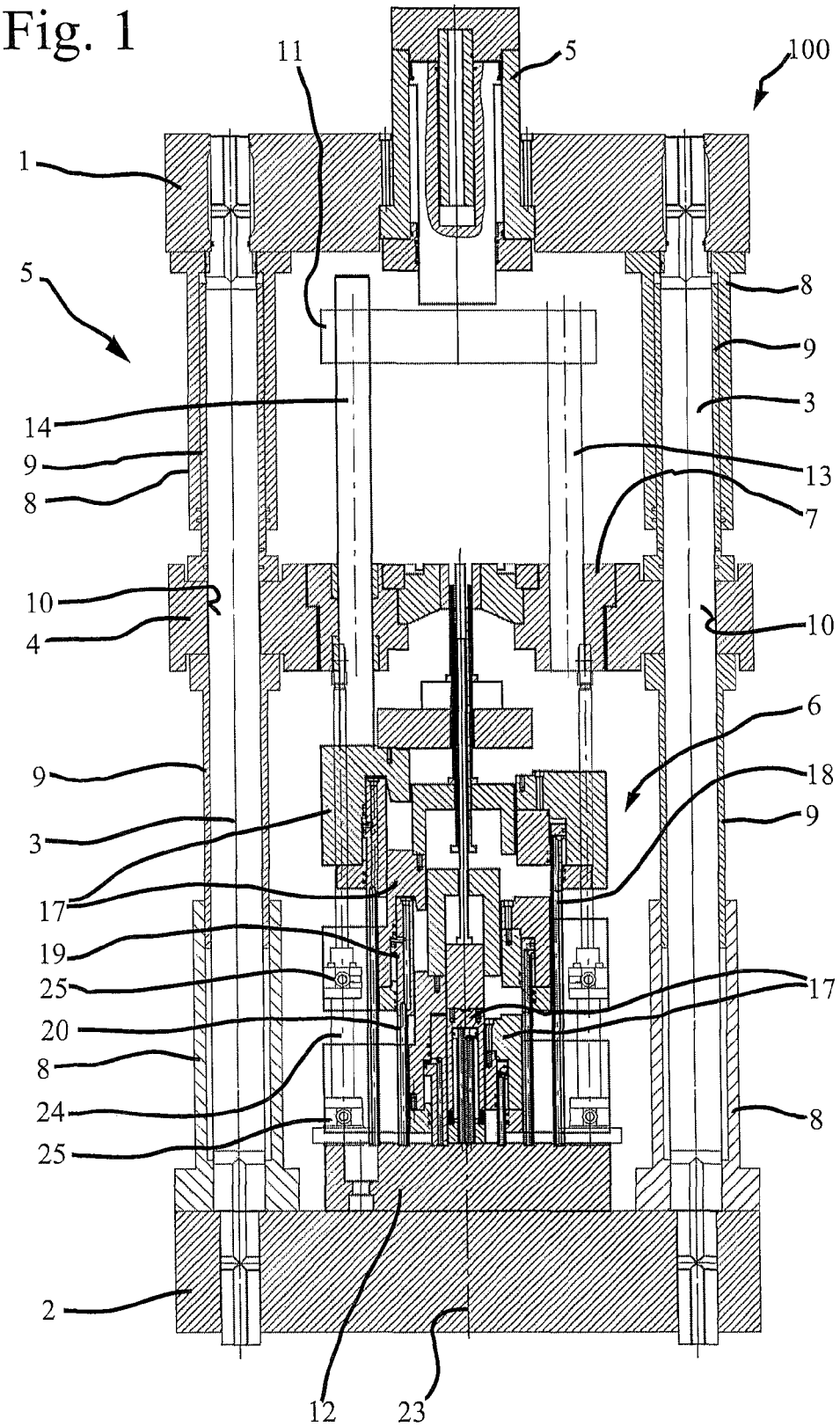
FIG. 1 shows a first embodiment of a powder press in a schematic cross-section.

Turning now in detail to the drawings, the powder presses 100, 200 shown in FIGS. 1-4 have an upper yoke 1 and a lower yoke 2, in each instance, as well as tension elements 3 (not shown in FIG. 3, because they are sufficiently known), with a die plate 7 provided to be axially displaceable relative to them, which plate, in these exemplary embodiments, is disposed on an adapter 6 and held by a die accommodation plate 4, which in turn is guided on the press frame formed by the upper yoke 1, lower yoke 2, and tension element 3.

The powder presses 100, 200 have punches 5 that are used as an upper punch or lower punch, whereby, for example, the lower punch can be used for displacement of the die accommodation plate 4 or of the die plate 7, while the upper punch can serve for application of the pressing force.

In the case of the powder presses 100, 200 explained as examples here, the punch 5 that is used as a lower punch is structurally implemented by means of cylinders 8 that are disposed on the upper yoke 1 and the lower yoke 2, in each instance, and pistons 9 that are provided on the die accommodation plate 4, whereby not only the cylinders 8 but also the pistons 9 surround passage openings 10 through the upper yoke 1, the lower yoke 2, and the die accommodation plate 4, as well as the tension elements 3. This arrangement allows a particularly compact design and also makes it possible here to reduce the risk that powder gets to the seals between cylinders 8 and pistons 9 to a minimum.

Figure 2:
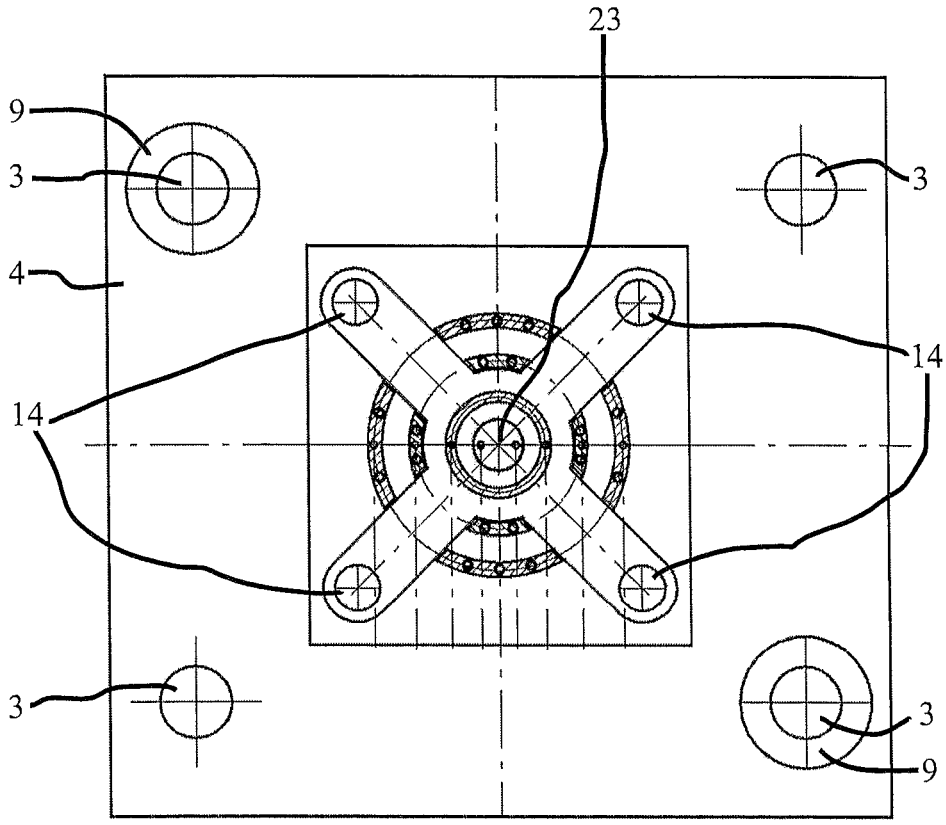
FIG. 2 is a horizontal section through the powder press according to FIG. 1.
Figure 3:
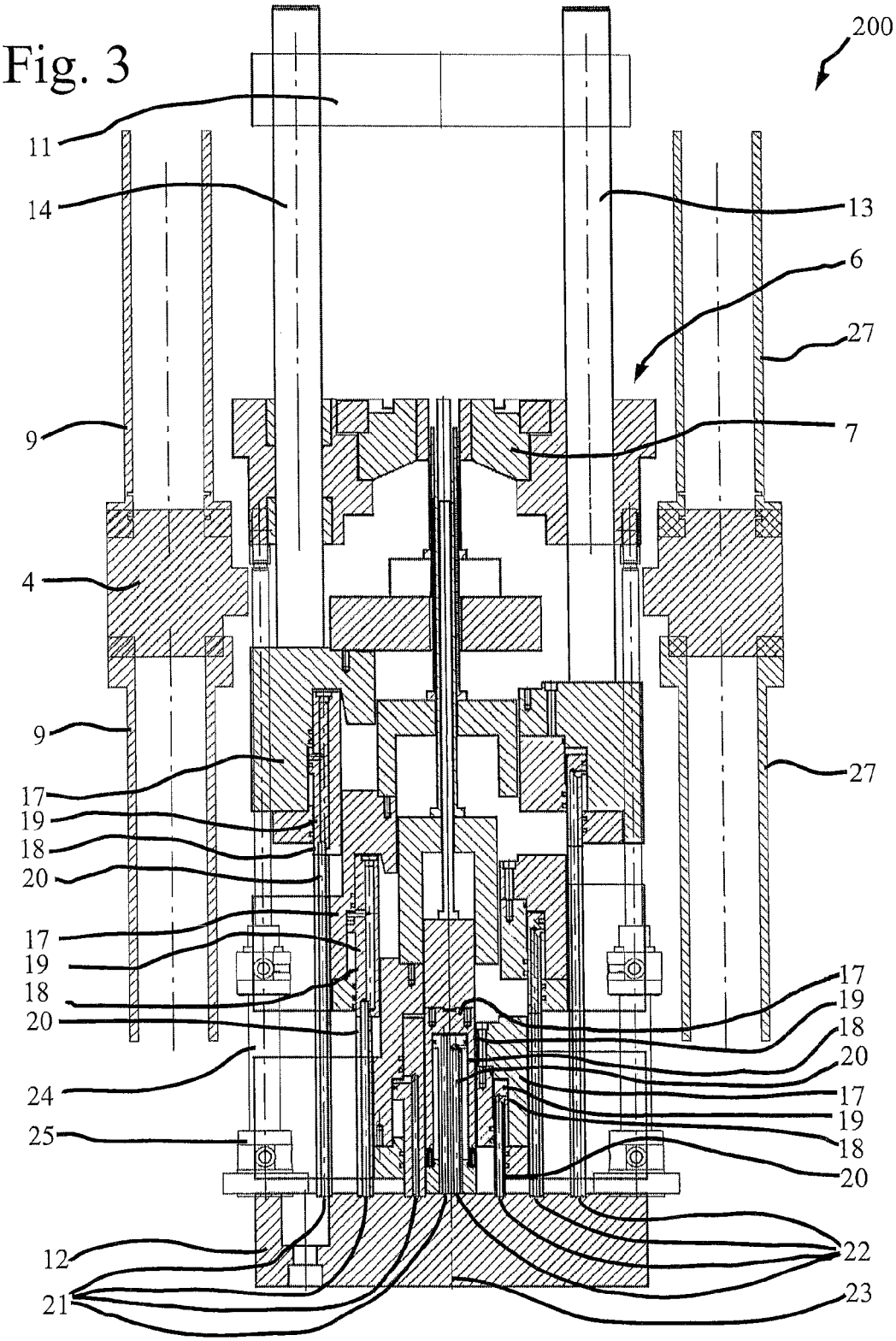
FIG. 3 shows a second embodiment of a powder press, in partial cross-section.
Figure 4:
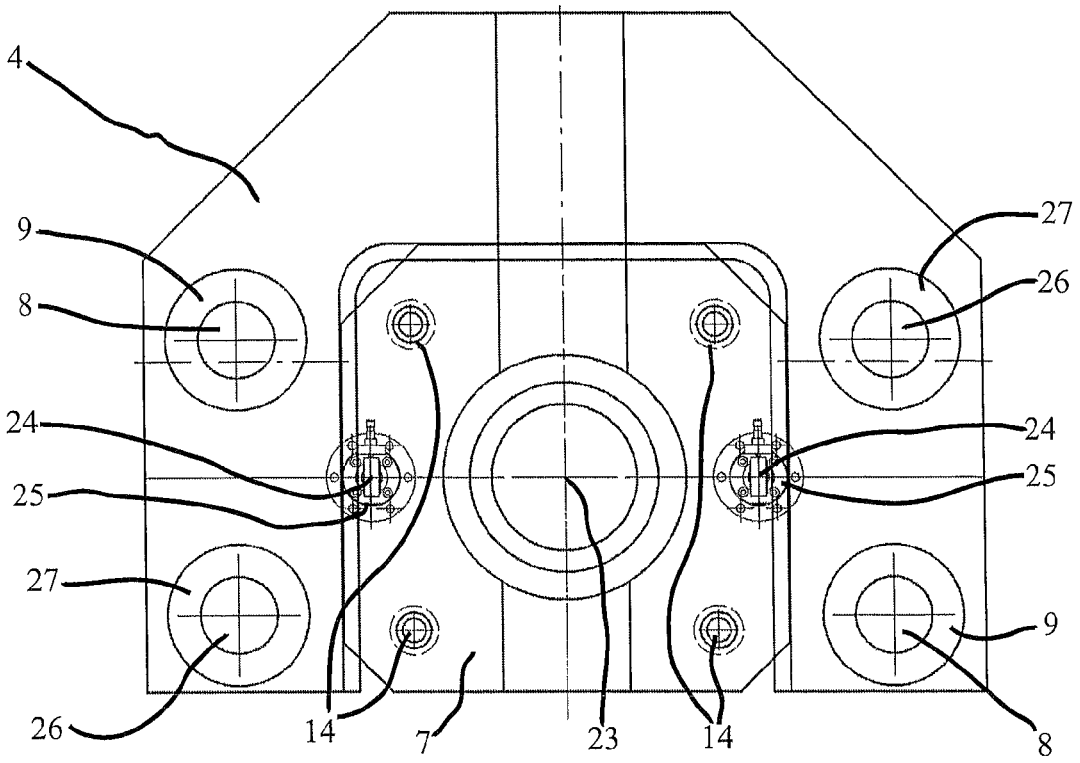
FIG. 4 shows the powder press according to FIG. 3 in a horizontal section.

Although the upper punch 5 is provided only on the upper yoke 1 in the exemplary embodiment shown in FIGS. 1 and 2, the punch 5 used as an upper punch in the exemplary embodiments shown in FIGS. 3 and 4 is also implemented by means of cylinders 26 disposed on the upper yoke 1 and lower yoke 2, as well as complementary pistons 27 that are provided on the die accommodation plate 4, in each instance. In this connection, the cylinders 8, 26 or pistons 9, 27 of the punches 5 are oriented diagonal to one another, in each instance, as is particularly shown in FIG. 4. In this manner, the forces can be uniformly applied. Furthermore, a powder press 200 configured in such a manner has a particularly compact construction.

The adapter 6 in turn comprises a head plate 11, a foot plate 12, and a guide 13, which is formed by guide rods 14 in this exemplary embodiment.

Below the die plate 7, multiple additional plates 17 configured as lower plates are disposed on the adapter, which plates are also guided on the guide 13, directly or indirectly. In this connection, the uppermost additional plate 17 is guided directly on the guide rods 14, while the further additional plates 17 are indirectly guided on the guide 13, by way of the upper additional plates 17, in each instance.

The additional plates 17 can be displaced or pressure can be applied to them by way of cylinder/piston units 18, in each instance. For this purpose, cylinders 19 are provided on each additional plate 17, which are configured to face downward, in other words away from the additional plate 17, in each instance, or from the die plate 7. In this way, it is possible to reduce the risk that powder collects on the seals of the cylinder/piston units 18 to a minimum.

The cylinders 19 of the upper additional plates 17 furthermore serve to guide the lower additional plates 17, which guarantees a particularly compact construction and compact guidance axially with regard to a center axis 23 of the overall arrangement.

Pistons 20 face downward, proceeding from the cylinders 19, in which pistons, in turn, flow 21 and return 22 to and from the cylinders 19 are provided. In this manner, the overall arrangement has a particularly compact structure.

Furthermore, an additional guide 24 configured in the form of guide rods is provided on the foot plate 12 of the adapter 6, which guide carries clamping and movement cylinders 25 that can also be utilized for tool installation.

Although only a few embodiments of the present invention have been shown and described, it will be apparent that many changes and modifications may be made thereunto without departing from the spirit and scope of the invention.

What is claimed is:

1. A powder press comprising:

(a) an upper yoke;

(b) a lower yoke;

(c) a plurality of tension elements in effect between the upper yoke and the lower yoke;

(d) a die plate guided parallel to the tension elements;

(e) a first cylinder/piston unit comprising a cylinder and a piston;

(f) at least one additional plate guided parallel to the tension elements and hydraulically activatable with reference to at least one of the die plate, the upper yoke, and the lower yoke or subjected to plate pressure via the first cylinder/piston unit; and (g) an adapter, the adapter comprising a die accommodation plate, a head plate that is in effect on a head side of the die plate, a foot plate that is in effect on a foot side of the die plate, and a guide for the die plate that is in effect between the head plate and the foot plate;

wherein the cylinder of the cylinder/piston unit is disposed facing away from at least one of the die plate and the at least one additional plate, wherein the die plate is provided on the adapter and accommodated on the die accommodation plate, and wherein the first piston/cylinder unit is self-supporting on the head plate, on the foot plate, or on a module rigidly connected with the head plate or with the foot plate.

2. The powder press according to claim 1, wherein the at least one additional plate is configured as a lower plate and the cylinder of the first cylinder/piston unit is disposed below the at least one additional plate.

3. The powder press according to claim 1, wherein the cylinder is disposed on the at least one additional plate.

4. The powder press according to claim 1, wherein the die plate and the at least one additional plate have a common guide.

5. The powder press according to claim 4, wherein the die plate guides the at least one additional plate.

6. The powder press according to claim 1, wherein the at least one additional plate comprises a first additional plate and a second additional plate guided by the first additional plate.

7. The powder press according to claim 1, wherein the cylinder is part of an additional plate guide.

8. The powder press according to claim 1, wherein the piston of the first piston/cylinder unit is switched to run synchronously or differentially with at least one further piston.

9. The powder press according to claim 1, further comprising a second piston/cylinder unit, wherein the surface area ratio of the first and second cylinder/piston units is 1:1.

* * * * *